United States Patent [19]

Brennan et al.

[11] Patent Number: 4,506,944

[45] Date of Patent: Mar. 26, 1985

[54] MODULAR CONNECTOR FOR TERMINATING EMI/RFI SHIELDED CORDAGE AND CORD TERMINATED THEREBY

[75] Inventors: Robert J. Brennan, Ossining; Terrence Meighen, Stormville, both of N.Y.

[73] Assignee: Stewart Stamping Corporation, Yonkers, N.Y.

[21] Appl. No.: 570,805

[22] Filed: Jan. 16, 1984

Related U.S. Application Data

[63] Continuation-in-part of Ser. No. 512,375, Jul. 11, 1983.

[51] Int. Cl.[3] ..... H01R 13/658

[52] U.S. Cl. ..... 339/143 R; 339/99 R

[58] Field of Search ..... 339/17 F, 99 R, 143 R, 339/176 MF, 176 MP, 14 R

[56] References Cited

U.S. PATENT DOCUMENTS

| | | | |
|---|---|---|---|
| 3,998,514 | 12/1976 | Hardesty | 339/99 R |
| 4,352,531 | 10/1982 | Gutter | 339/176 MF X |
| 4,457,575 | 7/1984 | Davis et al. | 339/176 MP X |

*Primary Examiner*—Eugene F. Desmond

*Attorney, Agent, or Firm*—Steinberg & Raskin

[57] ABSTRACT

An improved modular plug connector is provided with a contact as a part of the connector itself for terminating the foil shield of a cord to prevent or control the radiation of interference-causing electromagnetic and radio frequency signals from the region of the connector, such as when the cord is used in the transmission of high frequency digital-based data. The connector incorporating the shield terminating contact also advantageously provides for the isolation and grounding of electrostatic charge. The shield terminating contact is constituted by a contact pin which passes through a side wall of the connector housing into the cord-receiving cavity to electrically engage the cord shield.

8 Claims, 7 Drawing Figures

MODULAR CONNECTOR FOR TERMINATING EMI/RFI SHIELDED CORDAGE AND CORD TERMINATED THEREBY

BACKGROUND OF THE INVENTION

This application is a continuation-in-part of application Ser. No. 512,375 filed July 11, 1983.

This invention relates generally to electrical connectors for terminating cords and, more particularly, to so-called modular plug connectors currently being utilized in the telephone and data communications industries as well as in other applications.

Modular plug connectors are generally used to terminate both flat and round cords. Generally, a flat cord has a multiplicity of insulated conductors arranged in a spaced linear array within an outer jacket, while a round cord has a multiplicity of insulated conductors arranged in a spiral array within an outer jacket. Various configurations of such connectors are disclosed in several patents assigned to Western Electric Company, Inc., such for example as U.S., Pat. Nos. 3,699,498 issued Oct. 17, 1972; 3,761,869 issued Sept. 25, 1973; 3,860,316 issued Jan. 14, 1975; and 3,954,320 issued May 4, 1976. Another advantageous configuration of a modular plug connector is illustrated in U.S. Pat. No. 4,211,462 issued July 8, 1980 and assigned to Stewart Stamping Corporation, the assignee of the present application. Although such connectors have been made from two housing components bonded together (see, e.g., U.S. Pat. No. 3,761,869), it appears preferable to manufacture such connectors using a so-called unipartite or integrally molded housing (see, e.g., U.S. Pat. No. 3,998,514).

A modular plug connector generally includes a housing formed of dielectric material and which defines an internal cord receiving cavity into which the end of a cord is inserted through a cord-receiving aperture formed at one of the housing ends. The cord-receiving cavity includes a jacket-receiving portion adjacent the aperture and a communicating conductor-receiving portion into which the individual insulated conductors, from which the outer jacket has been stripped, are received. A plurality of flat contact terminals, corresponding in number to the number of conductors of the cord, are inserted into individual slots defined in the housing, each terminal being aligned with and electrically engaging a respective conductor. The conductors are generally of tinsel, stranded or solid construction while the terminals have blade-like portions which engage respective conductors in a solderless connection. The flat terminals have edges which are exposed externally of the housing for engagement with respective aligned wire contact elements provided in a jack receptacle. The cord end is secured to the connector by jacket anchoring and strain relief portions integrally hinged with the housing and movable against the cord so as to prevent separation of the connector from the cord during customer use as well as to provide strain-relief facilities for the conductors and jacket.

Modular plug connectors of the type described above are finding increased use in terminating multi-conductor cords through which digital information is transmitted. For example, modular plug connectors are finding increased use in terminating multi-conductor cordage used in home and office computers for connecting the computers with peripheral components, in data communications applications generally, in electronic games, in telephone communication networks and in similar digital applications.

It is now recognized that digital technology-based electronic equipment is a major source of electromagnetic (EMI) and radio frequency (RFI) interference. such interference has become a problem due at least in part to the movement away from metal and towards plastic as the material from which the connector housings are formed. Plastics generally lack the EMI/RFI shielding effectiveness inherent in metal housings.

In order to prevent or at least substantially control the emission of interference-causing electromagnetic and radio frequency radiation from multi-conductor cordage used in digital-based electronic equipment and to provide at least some protection from interference-causing signals radiated from external equipment, such cordage has conventionally been provided with "shielding" in the form of a continuous sheath of conductive material between the outer insulation jacket of the cord and the insulated conductors, the shield surrounding and enclosing the conductors along their length. The shield can be formed of any suitable conductive material, such as aluminum foil having a thickness of about 0.3 mils applied to treated Mylar having a thickness of about 1 mil or aluminum foil alone. Shields formed of braided metallic material have also been used in this connection. The shield acts to suppress or contain the interference-causing electromagnetic and radio frequency signals radiating outwardly from the conductors and, conversely, to prevent such high frequency signals radiated from external equipment from causing interference in the conductors.

When a shielded cord of the type described above is terminated by a modular plug connector, a so-called "drain wire" has conventionally been employed to ground the shield. The drain wire extends through the cord in electrical engagement with the conductive shield and is grounded by passing its end out of the connector and connecting it to a grounded terminal. In this manner, the shield is in effect terminated so that high frequency signals and any electrostatic charge conducted through the shield are "drained", i.e., grounded to thereby control the radiation or discharge thereof.

However, this technique has not satisfactorily eliminated the problem of interference caused by such radiation. Specifically, it has been found that there is still a tendency for EMI and RFI to result from the leakage of electromagnetic and radio frequency radiation signals from the cordage in the region at which the modular plug connector is inserted into the jack socket. Moreover, it is not uncommon for high frequency signals radiated from nearby equipment to pass through the jack and cause interference in the cord connectors.

The problem of leaking signals described above has become quite important and has in fact led to the recent issuance of governmental regulations specifying emission level limitations especially in connection with any electronic device that uses or generates pulses or timing signals at a rate in excess of 10,000 pulses per second. Moreover, since the shield is a current conductor, there is a danger of an electrostatic discharge occurring during operation of the equipment. Such a discharge comprises a high voltage discharge which arcs across the contacts of the connector and has the possible effect of shorting the electronic circuitry.

In parent application Ser. No. 512,375 filed July 11, 1983, a modular plug connector for a multi-conductor cord is disclosed which incorporates as parts of the connector itself a device for terminating the shield. In one disclosed embodiment, the shield terminating device comprises a contact pin which extends through the side wall of the connector housing so that a portion of its length electrically engages the shield. The head of the contact pin is exposed externally at the side of the connector. When the connector is inserted into the receptacle of a suitable jack, the head of the shield terminating contact pin electrically engages a grounded jack contact to lead the electromagnetic and radio frequency signals from the shield to ground. The contact pin in this embodiment extends through a passage formed in a lower region of the connector housing and which partially opens along its length into the lower wall of the conductor receiving portion of the cord-receiving cavity so that an upper portion of the contact pin engages a lower area of the shield, i.e., a region of the shield which extends underneath the conductors.

This arrangement, although being operational, has been found to be difficult in manufacture due to the problems encountered in boring a passage to accommodate the shield terminating contact pin which only partially opens into an existing open space, i.e., the conductor receiving portion of the cord-receiving cavity. Thus, it has been found that pieces of plastic material cut during the boring operation tend to move into the cavity obstructing the same which causes problems in the insertion of the cord end as well as other problems. Moreover, a more reliable electrical engagement of the shield and contact pin is always desirable.

SUMMARY OF THE INVENTION

Accordingly, one object of the present invention is to provide a new and improved modular plug connector for terminating EMI/RFI shielded cordage.

Another object of the present invention is to provide a new and improved modular plug connector for terminating EMI/RFI shielded cordage which effectively controls the radiation of high frequency signals for the region at which the modular plug connector is inserted in the jack socket and which protects the cordage from high frequency signals radiated by extraneous equipment.

Still another object of the present invention is to provide a new and improved modular plug connector for terminating EMI/RFI shielded cordage wherein the modular plug connector itself incorporates means for terminating the EMI/RFI shield.

Yet another object of the present invention is to provide a new and improved modular plug connector for terminating EMI/RFI shielded cordage which is easy to manufacture and is reliable in operation.

A further object of the present invention is to provide a new and improved modular plug connector for terminating EMI/RFI shielded cordage which will effectively drain electrostatic charge from the shield without the danger of damaging internal circuitry.

Briefly, in accordance with the present invention, these and other objects are attained by providing a shield terminating contact pin as a part of the modular plug connector itself. The contact pin is accommodated within a passage formed through a region of a side wall of the connector, opening at one end exteriorly of the housing and at its other end in an open region of the cord-receiving cavity to facilitate manufacture of the connector and at a position wherein the shield will electrically engage the contact pin when the cord is terminated. In particular, the contact pin accommodating passage is formed through a side wall of the modular plug connector at a region whereby it fully opens into an upper region of the cord-receiving cavity at a location so that the shield will be forcefully urged into electrical engagement with the contact pin situated in the passage when the cord is terminated. Thus, the contact pin accommodating passage opens into a fully open cavity and the manufacturing problems inherent in the previously suggested embodiments as discussed above are eliminated. When the modular plug connector is inserted into an appropriate receptacle, the outer exposed head of the contact pin electrically engages a grounded jack contact so that high frequency signals and any electrostatic charge conducted through the shield are conducted to ground thereby controlling the radiation of electromagnetic and radio frequency signals.

A preferred jack adapted to receive a modular plug connector in accordance with the present invention is disclosed in application Serial No. 570,806, entitled Jack For EMI/RFI Shield Terminating Modular Plug Connector, filed simultaneously herewith. The jack construction forms no part of the present invention.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
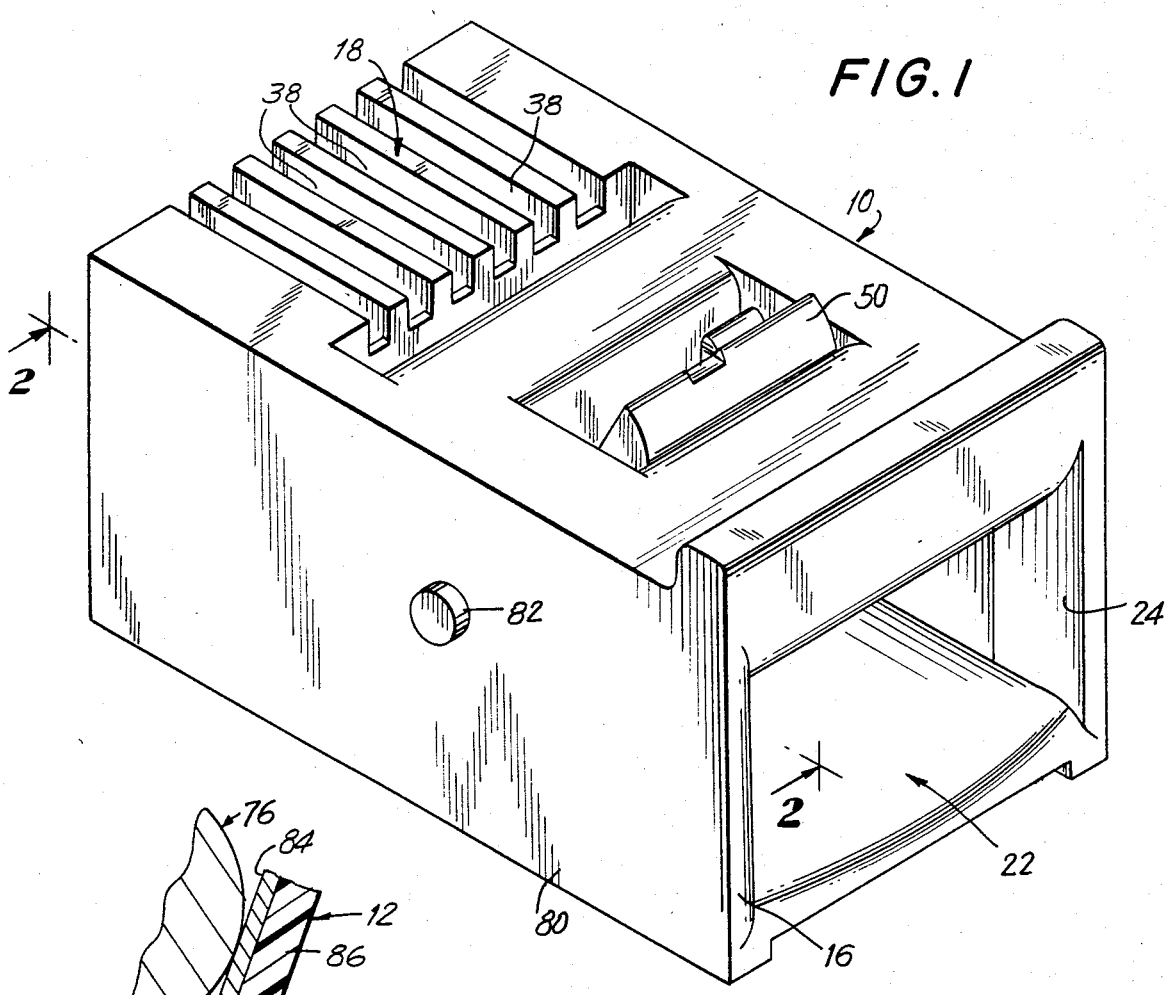
FIG. 1 is a perspective schematic view of a modular plug connector housing constructed in accordance with the present invention.

Referring now to the drawings wherein like reference characters designate identical or corresponding parts throughout the several views, a modular plug connector housing, generally designated 10, is illustrated which has been improved in accordance with the present invention through the incorporation of means for terminating a EMI/RFI shield, generally designated 12, of a multi-conductor cord 13. It is understood that the basic construction of the housing per se and the connector incorporating the same are substantially conventional and known to those skilled in the art.

The incorporation of means for terminating a cord shield as part of the modular plug connector itself provides vast improvement in the shielding of radiation of electromagnetic and radio frequency causing signals from cordage terminated by such modular plug connectors and, therefore, renders such connectors especially suitable for use with digital-based electronic equipment.

The construction of housing 10 of the modular plug connector will be briefly described. It is again noted that such construction is conventional and in this connection reference is made to the above-mentioned U.S. Pat. No.4,211,462 of Stewart Stamping Corporation which describes a typical housing construction in greater detail and the disclosure of said patent is hereby incorporated by reference herein. It is of course understood that the invention is not limited to the particular constuction of the housing shown and described.

The housing 10 is a rigid unipartite member formed of a suitable dielectric by conventional injection molding techniques. The housing 10 may be made of materials such, for example, as polycarbonate, polyamide, polystyrene, or polyester elastomers or related polymers such as ABS resin. The housing 10 has a closed forward free end 14, a cord receiving rearward end 16 and a terminal-receiving side 18 for receiving flat contact terminals 20 (FIG. 3).

The housing 10 defines a longitudinally extending cord-receiving cavity 22 which externally opens through a cord-receiving aperture 24 formed in the rearward end 16 of housing 10. The cord-receiving cavity includes a forward conductor-receiving portion 26 and a rearward enlarged jacket-receiving portion 28. The cavity 22 substantially encloses the entire end section of the cord with the terminal end portions of the conductors (having the jacket stripped therefrom) being received in the conductor-receiving portion 26 and the adjacent jacketed portion of the cord being received within the jacket-receiving portion 28. It is important to precisely locate the cord conductors 30 so that they are in direct aligned relationship with the respective slots formed in the terminal receiving side 18 which receive respective flat contact terminals 20. For this reason partitions 32 and upper and lower ridges 34, 36 extend through the conductor-receiving portion 26 to guide the end regions of respective conductors 30 into corresponding conductor troughs defined thereby .

A plurality of parallely spaced, longitudinally extending terminal-receiving slots 38 are formed through the terminal-receiving side 18 of housing 10, each slot 38 being aligned over a respective one of the conductor-receiving troughs. A pair of inwardly extending shoulders 40 and 42 (FIG. 2) are situated at about the mid-height of each slot 38. Each slot 38 is dimensioned so as to snugly receive a respective flat contact terminal 20 as described below.

Figure 3:
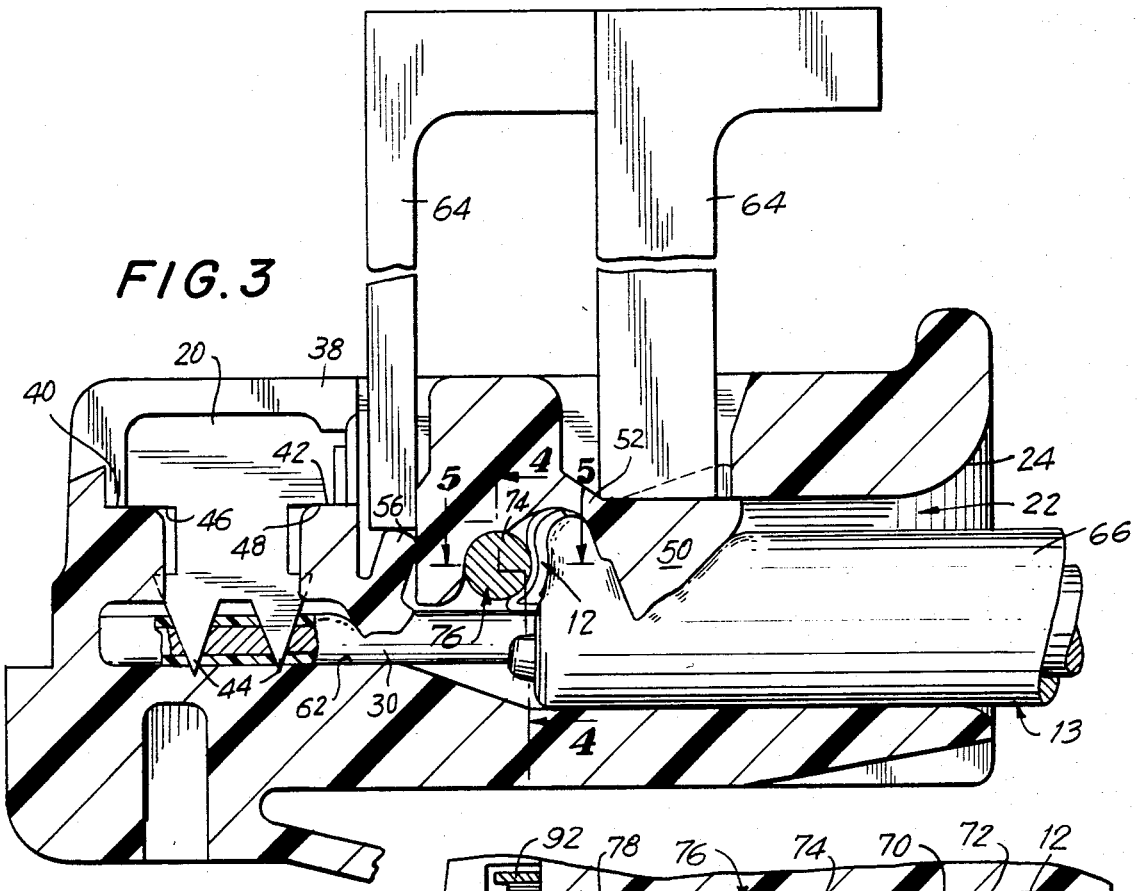
FIG. 3 is a longitudinal section view of a modular plug connector incorporating the housing shown in FIGS. 1 and 2 shown after termination of the inserted cord.

Referring to FIG. 3, each terminal 20 is constructed of an electrical conductive material, such as gold plated phosphor bronze. The terminal 20 has a flat conductor portion including a pair of insulation-piercing tangs 44. Each of the terminals are formed with a pair of outwardly extending shoulders 46 and 48. When a terminal 20 is inserted into an associated terminal-receiving slot 38, the points of tangs 44 of each terminal penetrate through a respective conductor 30 and become embedded in the lower wall 62 of the conductor-receiving portion 26 prior to terminal shoulders 46 and 48 engaging shoulders 40 and 42.

The housing 10 is also constructed with means for both securing the connector to the cord and for providing strain relief for the jacket and conductors. A jacket anchoring member 50 is integrally connected to housing 10 through a plastic hinge 52 and initially by a frangible portion 54 (FIG. 2) which supports the jacket anchoring members 50 in its initial position shown in FIG. 2 when a cord is receivable within cavity 22. The frangible portion 54 is constructed so as to shear upon the application of an inwardly directed force thereon by a suitable tool so that the jacket anchoring member can pivot about hinge 52 to engage the cord jacket. A conductor-anchoring member 56 is formed forwardly of the jacket-anchoring member 50 and extends transversely over the entire width of the conductor-receiving portion 26 of cavity 22. The conductor-anchoring member 56 is integrally connected to the housing 10 along its forward and rearward sides. The surfaces of the jacket and conductor anchoring member 50 and 56 may be formed with a plurality of parallel concave channels 58 and 60 respectively which advantageously enhance the securement of the cord in the housing as described in U.S. Pat. No. 4,211,462.

Prior to describing the improvement of the present invention, a typical assembly of the modular plug connector and securement to a cord will be described. Referring to FIG. 3, the end of a cord 13, which is shielded in a manner described below, is inserted through aperture 24 into the cord-receiving cavity 22 of housing 10. A certain length of the jacket 66 is stripped from the cord 13 so that as the cord is fully inserted into the cavity 22, respective insulated conductors 30 are separated and guided into respective troughs aligned with respective terminal-receiving slots 38 and such that the conductors become situated below the conductor-anchoring member 56 and the cord jacket becomes situated below the jacket anchoring member 50. Terminals 20 are inserted into respective slots 38 and driven towards the conductors so that the tangs 44 of each terminal 20 penetrate the insulation of each conductor thereby making electrical connection therewith and until the points of the tangs become embedded in the bottom wall 62 and terminal shoulders 56 and 58 engage housing shoulders 40 and 42. The jacket and conductor-anchoring members 50 and 56 are driven downwardly by means of a suitable tool 62. The frangible portion 54 shears so that the jacket-anchoring member 50 pivots into engagement with the jacket 66 of cord 58 to provide a reliable mechanical securement of the cord to the connector. Similarly, one of the web-like portions connecting the conductor-anchoring member 56 to the housing is sheared and the conductor-anchoring member moves against the conductors 30 to provide strain relief for the conductors .The anchoring members are locked in the cord-engaging positions shown in FIG. 4 by suitable conventional locking structure.

The construction of the connector housing, assembly of the modular plug connector incorporating the same and the termination of the cord by the connector as described above is conventional. The improvement according to the present invention is described below.

In accordance with the present invention, the modular plug connector is provided with means for terminating the EMI/RFI shield of a cord as a part of the connector itself so that electromagnetic and radio frequency interference-causing signals conducted through the shield can be conducted through the connector to a grounded contact in a jack.

Figure 2A:
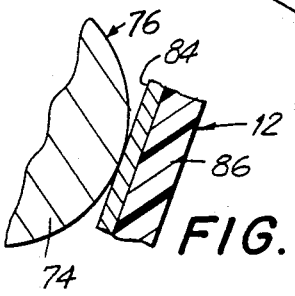
FIG. 2A is an enlarged detail view of the portions of the shield and contact pin shown in the area designated A in FIG. 2.
Figure 2:
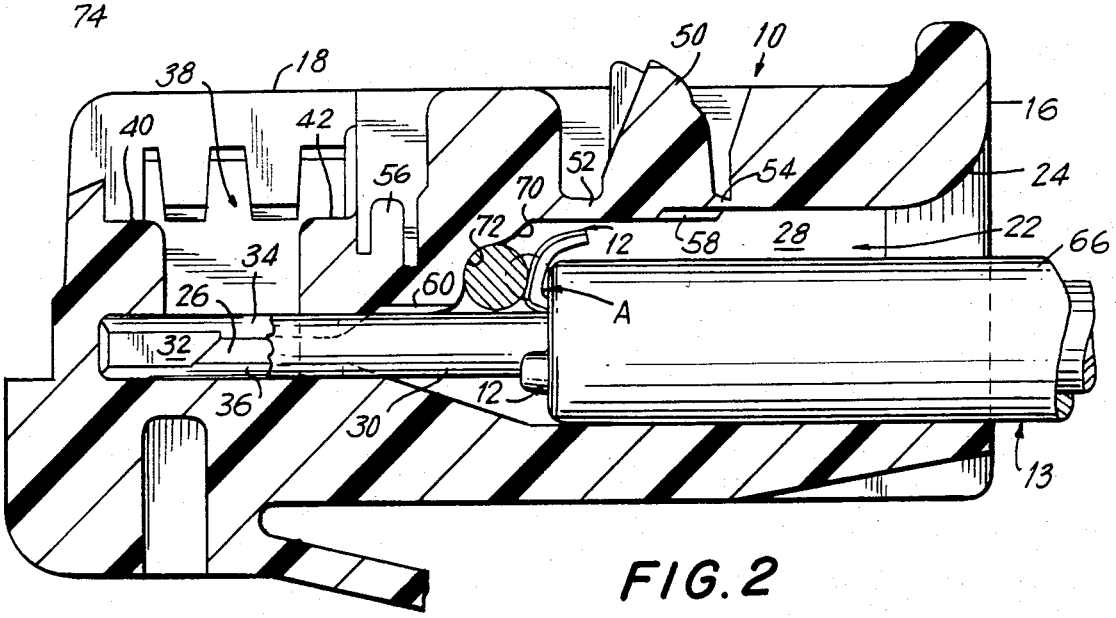
FIG. 2 is a longitudinal section view taken along line 2—2 of FIG. 1 and illustrating the end of a shielded multi-conductor cord inserted within the cord-receiving cavity of the connector housing with a portion of the shield being exposed.
Figure 4:
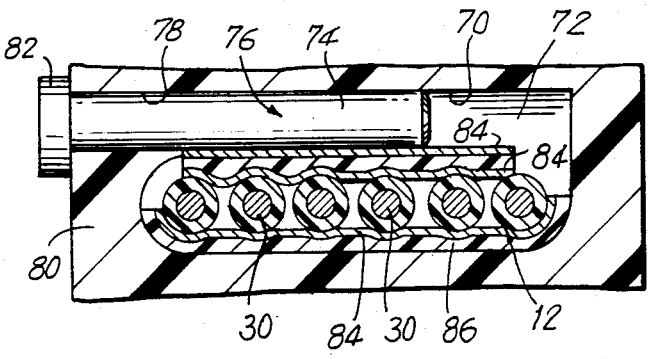
FIG. 4 is a section view taken along line 4—4 of FIG. 3.

Referring to FIGS. 1, 2 and 4, the housing 10 in accordance with the invention is molded so that the downwardly facing surface 70 of cord-receiving cavity 22 in the region of the transition between the conductor and jacket-receiving portions 26 and 28 has a substantially quarter-cylindrical surface segment 72. The cylindrical surface segment 72 forms a bearing surface for the shank 74 of the shield terminating contact pin 76. A circular opening 78 is formed in a side wall 80 of housing 10 coaxial with the cylindrical surface segment 72 and having a radius substantially equal to the radius of curvatures of the cylindrical surface segment 72. It is thus seen that the opening 78 opens at one end exteriorly of the housing and at its other end in an open region of the cord-receiving cavity 22 thereby facilitating its formation without pieces of plastic which are cut from the housing during formation passing into the cord-receiving cavity.

The contact pin 76 is formed of electrically conductive material, such as gold plated phosphor bronze. Contact pin 76 includes the cylindrical shank 74 having a radius substantially equal or slightly smaller than the radius of opening 78 and the radius of curvature of the cylindrical surface segment 72, and an enlarged disc-shaped head 82 at one end of the shank 74. The other end of the shank 74 is passed through the circular opening or passage 78 in housing side wall 80 until the head 82 abuts against the outer surface of side wall 80. It will be understood that a segement of the surface of the contact pin shank 74 will be contiguous with the cylindrical surface segment 72 of the downwardly facing surface 70 of cord-receiving cavity 22 as seen in the figures. The contact pin will be held in this position through its engagement within the passage 78.

Referring to FIGS. 2 and 2A, the cord 13 in the illustrated embodiment includes a plurality of insulated conductors 30 surrounded by a shield constituted by a sheath of aluminum foil 84 (FIG. 2A) applied to a sheath of Mylar 86. The shield 12 extends along the length of the cord 13 with the aluminum foil 84 next to the conductors 30. Prior to the insertion of the end of cord 13 into the cord-receiving receiving cavity 22, the end portion of the outer insulation jacket 66 is removed exposing the shield 12. The portion of the exposed shield 12 which overlies the conductors 30 is folded back over the outer surface of jacket 66 as seen in FIG. 2 so that the aluminum foil layer 84 is exposed and faces forwardly at the portion in front of the jacket 66. The remaining portions of the shield 12 can be removed if desired.

With the cord end prepared as described above, it is inserted into the cord-receiving cavity 22 through entrance opening 24 so that the conductors 30 enter into respective conductor-receiving troughs as described above. At the time, the forwardly facing exposed layer of aluminum foil 84 is urged against the surface of the shank 74 of contact pin 76 as seen in FIGS. 2 and 2A whereby an electrical engagement between the shield 12 and contact pin 76 is achieved.

With the cord being held in position so that the aluminum foil layer 84 of the shield 12 is in tight engagement with the contact pin shank 74, the flat contact terminals 20 are inserted as described above and the jacket and conductor-anchoring members 50 and 56 driven downwardly to their locked position by tools 64 as seen in FIG. 3.

Figure 5:
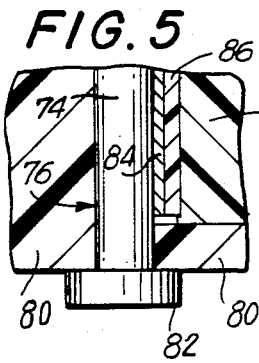
FIG. 5 is a section view taken along line 5—5 of FIG. 3.

Locking of the jacket-anchoring member 50 to its locked position as seen in FIG. 3 causes the portion of the jacket 66 situated forwardly thereof to be deformed and flow upwardly to substantially fill the space between the forward jacket contacting surface thereof and the downwardly facing surface 70 of the cord-receiving cavity 22 at the transition between the conductor and jacket receiving portions 26 and 28. This in turn forcefully urges the exposed portion of shield 12 against the shank 74 of contact pin 76 to provide an extremely reliable electrical engagement between the aluminum foil layer 84 of the shield and the rearwardly facing surface segment of the shank 74 of contact pin 76 as seen in FIGS. 3 and 5. Moreover, a portion of the exposed shield 12 is urged under the force of the jacket-anchoring member 50 underneath the shank 74 as seen in FIGS. 3 and 4 to even further enlarge the area of electrical contact between the shield and contact pin.

Figure 6:
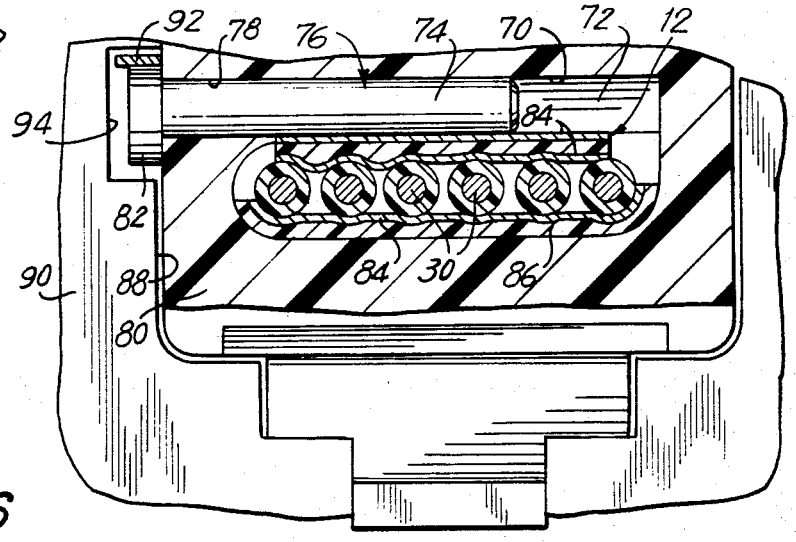
FIG. 6 is a section view of the modular plug connector inserted into the receptacle of a jack provided with a grounded contact for electrically engaging the shield terminating contact pin of the modular plug connector.

Referring to FIG. 6, the modular plug connector terminating the end of the cord is inserted into the receptacle 88 of a suitable jack 90 provided with a linear array of contact wires (not shown) adapted to engage the upper edges of respective flat contact terminals 20 through the upper regions of slots 38 to effect electrical connections therewith. The jack 90 is also provided with a grounded contact 92 adapted to engage the head 82 of contact pin 76 when the modular plug connector is fully inserted within the receptacle 88 to thereby ground the shield 12. A channel 94 is formed in receptacle 88 to accommodate the grounded contact 92 and head 82 of contact pin 76.

It will be understood from the foregoing that the electromagnetic and radio frequency interference-causing signals and any electrostatic charge present in the aluminum foil layer 84 of shield 12 will be conducted through the modular plug connector by the contact pin 76 to the grounded jack contact 92 to ground. In this manner, the possibility of leakage of interference causing signals from the region of the connector is effectively eliminated. The manufacture of the modular plug connector in accordance with the invention is facilitated by the provision that the passage or opening 78 opens into a fully opened space within the cord-receiving cavity and, moreover, the electrical contact between the shield and the contact pin is extremely reliable due to the forceful urging of the shield against the contact pin by the cord jacket under the force of the jacket-anchoring member 50.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A modular plug connector for terminating a shielded cord having a plurality of insulated conductors enclosed within an outer jacket and a conductive shield between the jacket and conductors and enclosing the latter substantially along their length, comprising: a dielectric housing having side walls, a forward free end and a rearward cord input end having an aperture formed therein opening into a cord-receiving cavity formed within the housing, said cord-receiving cavity having a forward conductor-receiving portion and a rearward jacket-receiving portion, a plurality of flat contact terminal openings for receiving flat contact terminals adapted to electrically engage respective ones of the cord conductors; an opening formed through one of said housing side walls which opens at one of its ends at the exterior surface of said housing side wall and at the other of its ends at a fully open region of the cord-receiving cavity; and a contact pin extending through said opening, said contact pin having one end exposed at the exterior surface of said housing side wall and a shank situated within said cord-receiving cavity adapted to electrically engage an exposed portion of the conductive cord shield to terminate the same.

2. The combination of claim 1 wherein said cord-receiving cavity includes a transition region between said conductor and jacket-receiving portions having a downwardly facing surface, and wherein said contact pin shank is situated with a segment of its surface contiguous with a segment of said downwardly facing surface.

3. The combination of claim 2 wherein said contact pin shank is substantially cylindrical and wherein said contiguous segment of said downwardly facing surface of said cord-receivng cavity has a corresponding substantially cylindrical shape.

4. The combination of claim 2 wherein said housing includes an integral jacket-anchoring member situated rearwardly of said transition region and extending transversely across said housing and connected thereto for movement from an unlocking position to a locking position wherein a surface thereof is located at least partially within said jacket-receiving portion of said cord-receiving cavity.

5. A modular plug connector terminating a shielded cord, comprising: a cord having a plurality of insulated conductors enclosed within an outer jacket and a conductive shield between the jacket and conductors and enclosing the latter substantially along their length; a modular plug connector including a dielectric housing having side walls, a forward free end and a rearward cord input end having an aperture formed therein opening into a cord-receiving cavity formed within the housing, said cord-receiving cavity having a forward conductor-receiving portion and a rearward jacket-receiving portion; an end portion of said cord having the jacket removed therefrom to expose a portion of said conductive shield and said conductors, said cord end portion inserted within said cord-receiving cavity; a plurality of flat contact terminals forming a part of said modular plug connector, each of said flat contact terminals electrically engaging a respective one of said cord conductors in said conductor-receiving portion of said housing; an opening formed through one of said housing side walls which opens at one of its ends at the exterior surface of said housing side wall and at the other of its ends at a fully open region of the cord-receiving cavity; a contact pin extending through said opening, said contact pin having one end exposed at the exterior surface of said housing side wall and a shank situated within said cord-receiving cavity; and wherein said shank of said contact pin electrically engages said exposed portion of said conductive shield.

6. The combination of claim 5 wherein said cord-receiving cavity includes a transition region between said conductor and jacket-receiving portions having a downwardly facing surface, and wherein said contact pin shank is situated with a segment of its surface contiguous with a segment of said downwardly facing surface.

7. The combination of claim 6 wherein said contact pin shank is substantially cylindrical and wherein said contiguous segment of said downwardly facing surface of said cord-receiving cavity has a corresponding substantially cylindrical shape.

8. The combination of claim 6 wherein said housing includes an integral jacket-anchoring member situated rearwardly of said transition region and extending transversely across said housing and connected thereto for movement from an unlocking position to a locking position wherein a surface thereof is located at least partially within said jacket-receiving portion of said cord-receiving cavity, said jacket-anchoring member being in its locking position and engaging the jacket of said cord and forcefully urging the portion of the jacket forward of said member towards said contact pin shank to forcefully urge the exposed portion of said shield into electrical engagement with said contact pin shank.

* * * * *